US012674611B2

(12) United States Patent
Lee et al.

(10) Patent No.: US 12,674,611 B2
(45) Date of Patent: Jul. 7, 2026

(54) RUNNING-WATER-TYPE EVAPORATOR, AND ICE-MAKING DEVICE AND WATER PURIFICATION DEVICE COMPRISING SAME

(71) Applicant: COWAY CO., LTD., Gongju-si (KR)

(72) Inventors: Gyeong Min Lee, Gongju-si (KR); Gyeong Jong Kim, Gongju-si (KR); Hyun Woo Lee, Gongju-si (KR); In Du Choi, Gongju-si (KR); Jae Man Kim, Gongju-si (KR); Jung Chul Park, Gongju-si (KR); Min Chul Yong, Gongju-si (KR); Sung Hwan Heo, Gongju-si (KR); Byung Hyo Ye, Gongju-si (KR); Chung Rae Kim, Gongju-si (KR); Jae Wook Cho, Gongju-si (KR)

(73) Assignee: COWAY CO., LTD., Gongju-si (KR)

( * ) Notice: Subject to any disclaimer, the term of this patent is extended or adjusted under 35 U.S.C. 154(b) by 370 days.

(21) Appl. No.: 18/257,936

(22) PCT Filed: Dec. 1, 2021

(86) PCT No.: PCT/KR2021/018040
§ 371 (c)(1),
(2) Date: Jun. 16, 2023

(87) PCT Pub. No.: WO2022/131631
PCT Pub. Date: Jun. 23, 2022

(65) Prior Publication Data

US 2024/0053078 A1 Feb. 15, 2024

(30) Foreign Application Priority Data

Dec. 17, 2020 (KR) ..... 10-2020-0177275

(51) Int. Cl.
*F25C 1/12* (2006.01)
*F25C 1/25* (2018.01)

(52) U.S. Cl.
CPC ..... *F25C 1/12* (2013.01); *F25C 1/25* (2018.01); *F25C 2400/14* (2013.01)

(58) Field of Classification Search
CPC ..... F25C 5/10; F25C 2400/14; F25C 1/25; F25C 1/12
See application file for complete search history.

(56) References Cited

U.S. PATENT DOCUMENTS 4,823,559 A 4/1989 Hagen
4,843,827 A 7/1989 Peppers
(Continued)

FOREIGN PATENT DOCUMENTS

JP 2005-233457 A 9/2005
JP 2007-278620 A 10/2007
(Continued)

OTHER PUBLICATIONS

International Search Report issued Mar. 23, 2022 in PCT/KR2021/018040 filed on Dec. 1, 2021, 2 pages.
(Continued)

*Primary Examiner* — Cassey D Bauer
(74) *Attorney, Agent, or Firm* — Oblon, McClelland, Maier & Neustadt, L.L.P.

(57) ABSTRACT

The present invention relates to a running-water-type evaporator, and an ice-making device and a water purification device comprising the same, and to a running-water-type evaporator, and an ice-making device and a water purification device comprising the same, the evaporator uniformly transferring, to ice, heat supplied through high-temperature fluid during ice separation, so as to enable the ice to be easily separated without using separate ice-separating water, and
(Continued)

thus minimizes melting of the ice during ice separation, and circulating ice-making water in a state where the ice-making water flows only toward the outer sides of a pair of outer plate members, and thus a degradation in the cleanliness of the ice-making water can be prevented.

15 Claims, 10 Drawing Sheets

(56) References Cited

U.S. PATENT DOCUMENTS

| | | | | |
|---|---|---|---|---|
| 2004/0187513 | A1* | 9/2004 | Allison | F25B 39/02<br>29/890.038 |
| 2007/0157652 | A1 | 7/2007 | Hirmatsu | |

FOREIGN PATENT DOCUMENTS

| | | | |
|---|---|---|---|
| JP | 2009-264729 | A | 11/2009 |
| JP | 2011-231943 | A | 11/2011 |
| KR | 10-2011-0069248 | A | 6/2011 |
| KR | 10-1335953 | B1 | 12/2013 |
| KR | 10-2015-0015562 | A | 2/2015 |
| KR | 10-2015-0027534 | A | 3/2015 |
| WO | WO 98/01714 | A1 | 1/1998 |

OTHER PUBLICATIONS

Extended European Search Report issued Sep. 9, 2024 in European Patent Application No. 21906936.6, 11 pages.
Office Action issued in Korean Patent Application No. 10-2020-0177275 on Jan. 20, 2026, with English translation.

* cited by examiner 210 (211, 212)

RUNNING-WATER-TYPE EVAPORATOR, AND ICE-MAKING DEVICE AND WATER PURIFICATION DEVICE COMPRISING SAME

CROSS-REFERENCE TO RELATED APPLICATIONS

This application claims priority to and the benefit of Korean Patent Application No. 10-2020-0177275, filed on Dec. 17, 2020, the disclosure of which is incorporated herein by reference in its entirety.

TECHNICAL FIELD

The present invention relates to a running-water-type evaporator, and an ice-making device and a water purification device including the same, and to a running-water-type evaporator, and an ice-making device and a water purification device including the same, the evaporator uniformly transferring, to ice, heat supplied through high-temperature fluid during ice separation, so as to enable the ice to be easily separated without using separate ice-separating water, and thus minimizes melting of the ice during ice separation, and circulating ice-making water In a state where the ice-making water flows only toward the outer sides of a pair of outer plate members, and thus a degradation in the cleanliness of the ice-making water can be prevented.

BACKGROUND ART

In general, the running-water-type evaporator is used in devices for generating ice by flowing ice-making water on the surface of an evaporator, and then removing the generated ice from the evaporator and providing the same to a user. Such a running-water-type evaporator may be used in various devices requiring ice generation, such as ice-making devices, water purification devices and the like.

Korea Registered Patent No. 10-1335953 of Daeyoung E&B Co., Ltd. discloses a conventional ice maker. The ice maker is provided with an evaporator through which a low-temperature fluid flows, an ice making plate which is vertically arranged to contact the evaporator, a water tank which is disposed below the ice making plate to store water (ice-making water and ice-separating water) falling from the ice making plate, and an ice storage which is provided outside the water tank to store falling ice. In addition, the ice-making plate is p with a compartment partition for partitioning each ice such that a plurality of ice are generated in the horizontal direction. When water flows through the ice-making plate, ice is generated in a part in contact with the evaporator, and particularly, the generated ice is generated in a state of being attached to not only the ice-making plate but also to the compartment partition. Therefore, in order to separate ice, it is necessary to quickly separate all parts that have ice attached thereto, and in order to separate the parts attached to the ice-making plate, a high-temperature fluid is supplied to the evaporator, and in order to separate the parts attached to the compartment partition, the ice-separating water flows to the inner side of the compartment partition, that is, to the part where the evaporator is placed. If the ice-separating water is not used, the part attached to the compartment partition will not be separated quickly, and the size of the ice will become very small due to the high temperature fluid that is supplied to the evaporator, and accordingly, since there may be a problem in reducing user satisfaction, it is inevitable to use ice-separating water. However, as this ice-separating water s configured to pass through the outer side surface of the evaporator made of copper tube, collect in the water tank and circulate together with the ice-making water, there is a problem in that the cleanliness of generated ice is reduced.

The ice-making unit disclosed in Japanese Patent Application No. 2009-264729 of HOSHIZAKI ELECTRIC CO. LTD. is provided with an ice-making plate in which a plurality of protrusions extending in the vertical direction are installed at predetermined intervals in the transverse direction, and an evaporation tube which is disposed on the back side of the ice-making plate and extends in the transverse direction. When ice-making water flows through the ice-making plate, ice is generated on the part in contact with the evaporation tube, and the ice produced in this way is formed to be attached to the ice-making plate and the protrusion. When the ice separation operation to separate the ice starts, the high-temperature fluid valve is opened to circulate a high-temperature fluid to the evaporation tube, and the water supply valve is also opened to supply ice-removing water to the back surface of the ice-making plate. Even in this case, there is still a problem in that the cleanliness of generated ice is reduced, as it is configured such that the ice-separating water is collected in the water tank after passing through the outer side surface of the evaporator that is made of copper tube and circulated together with the ice-making water.

(Patent Document 1) Korean Registered Patent No. 10-1335953

(Patent Document 2) Japanese Patent Application No. 2009-264729

DISCLOSURE

Technical Problem

In order to solve the above problems, the running-water-type evaporator according to the present invention is directed to improving the cleanliness of ice-making water by being configured to minimize the degree of ice melting during ice separation and circulating the ice-making water while flowing only to the outer sides of a pair of outer plate members, because during ice separation, the heat supplied through a high-temperature fluid is evenly transferred to ice such that the ice can be easily separated without using separate ice-separating.

The running-water-type evaporator according to an exemplary embodiment of the present invention is directed to improving structural stability by preventing a high-temperature fluid from leaking into a pair of outer plate members, because the supply groove and the partition wall are closed as the outer plate member and the inner plate member are disposed to be coupled to each other.

The running-water-type evaporator according to an exemplary embodiment of the present invention is directed to improving user convenience by being configured to generate ice at each location where a low-temperature fluid flows and generate several ices at the same time in the process of flowing ice-making water between the adjacent partition walls.

The running-water-type evaporator according to an exemplary embodiment of the present invention is directed to improving productivity through a simplified configuration by being configured to supply a high-temperature fluid to all of a plurality of partition walls even when the high-temperature liquid is suppled to any one of the partition walls, as connecting grooves are formed such that the partition walls communicate with each other.

The running-water-type evaporator according to the embodiment of the present invention is directed to improving the structural stability of a main groove by configuring a low-temperature fluid to move through the main groove that is formed in a pair of flow plate members.

The running-water-type evaporator according to an exemplary embodiment of the present invention is directed to improving user satisfaction by being configured such that a low-temperature fluid moves through the main groove, and heat is transferred in the process of direct contact of the low-temperature fluid to the heat transfer surface through a first opening hole, thereby improving ice-making performance and easily separating ice during ice separation.

The running-water-type evaporator according to an exemplary embodiment of the present invention is directed to improving user satisfaction, because the inner plate member is disposed to be bonded to the heat transfer surface to prevent a high-temperature fluid from leaking into a pair of outer plate members, and at the same time, while the low-temperature fluid passing through the first opening hole sequentially passes through a second opening hole, it not only improves ice making performance by directly contacting the heat transfer surface, but also easily separates ice during ice separation.

The running-water-type evaporator according to an exemplary embodiment of the present invention is directed to improving user satisfaction through improved ice making performance and quick separation of ice, because the heat transfer column is in surface contact with the heat transfer surface, thereby improving the heat transfer performance, and the first opening hole is formed at the front end of the heat transfer column such that the low-temperature fluid directly contacts the heat transfer surface.

The running-water-type evaporator according to an exemplary embodiment of the present invention is directed to improving structural stability, because the outer side surface of the heat transfer column is supported by the support surface that is formed in the second opening hole while the heat transfer column is inserted into the second opening hole such that the flow plate member and the inner plate member can be assembled to each other at the correct position during the assembly process, and ensures that the assembly state between these members is stably maintained after assembly.

The running-water-type evaporator according to an exemplary embodiment of the present invention is directed to improving user satisfaction through the quick separation of ice, because the inner plate members are disposed to be bonded to each other while supply grooves are formed in a pair of outer plate members, respectively, and a high-temperature fluid is supplied independently of each other.

The running-water-type evaporator according to an exemplary embodiment of the present invention is directed to improving structural stability by stably coupling a pair of flow plate members to each other through a coupling piece.

The running-water-type evaporator according to an exemplary embodiment of the present invention is directed to improving structural stability, because the assembled state between the flow plate member and the inner plate member is stably maintained, as the support piece that is formed on the flow plate member and the counter piece that is formed on the inner plate member are supported in contact with each other.

The running-water-type evaporator according to an exemplary embodiment of the present invention is directed to preventing degradation in the cleanliness of ice-making water, because bonding surfaces are provided around the periphery of a pair of outer plate members to seal the inner sides of a pair of outer plate members such that the air or ice-making water does not flow therein.

The running-water-type evaporator according to an exemplary embodiment of the present invention is directed to improving manufacturing easiness, because it is possible to secure an internal space in which the flow plate member can be placed by forming bent surfaces on the pair of outer plate members, respectively.

The ice-making device including the running-water-type evaporator according to the present invention is directed to improving the cleanliness of ice-making water, because an ice-making water supply unit for supplying ice-making water and a heat transfer fluid supply unit for supplying a low-temperature fluid or a high-temperature fluid to the inside of the evaporator are provided to generate ice, and during ice separation, the heat supplied through the high-temperature fluid is evenly formed into ice, and since the ice can be easily separated without using separate ice-separating water, the degree of ice melting during ice separation is minimized, and it is configured such that the ice-making water circulates while flowing only to the outer sides of a pair of plate members.

The water purification device including the running-water-type evaporator according to the present invention is directed to improving the cleanliness of ice-making water, because raw water is filtered to generate purified water, and the generated purified water is supplied to generate ice, and during ice separation, the heat supplied through a high-temperature fluid is evenly transferred to the ice, and since the ice can be easily separated without using separate ice-separating water, the degree of ice melting during ice separation is minimized, and also, it is configured such that the ice-making water circulates while flowing only to the outer sides of a pair of plate members.

Technical Solution

In order to achieve the above objects, the running-water-type evaporator according to the present invention may include a pair of outer plate members that are disposed to face each other; and a flow plate member which is disposed between the pair of outer plate members to partition a space between the pair of outer plate members so as to form a first flow path through which a low-temperature fluid for generating ice or a high-temperature fluid for separating the generated ice flows, wherein the outer plate member includes a heat transfer surface which is formed on the inside to thermally contact the fluid, an ice generating surface which is formed on the outside such that a first surface of ice is formed to be attached thereto, a partition wall which protrudes outward to partition the ice generating surface such that a second surface which is formed to extend from the first surface of ice is attached thereto and extends in a direction crossing the flow direction of the fluid flowing through the first flow path, and a supply groove which protrudes outward to form a second flow path that communicates with the inside of the partition wall such that a high-temperature fluid is supplied to the inside of the partition wall.

The running-water-type evaporator according to an exemplary embodiment of the present invention is characterized by further including an inner place member which is disposed to be bonded to the heat transfer surface so as to prevent the fluid flowing inside the supply groove and the partition wall from leaking into a space between the pair of outer plate members.

In the running-water-type evaporator according to an exemplary embodiment of the present invention, the partition wall may be formed to extend in parallel with a direction in which the ice-making water flows, and a plurality of the partition walls may be disposed to be spaced apart from each other at regular intervals, and wherein the outer plate member may further include a connection groove such that the partition walls that are disposed to be adjacent to each other communicate with each other, and a discharge groove through which the fluid flowing inside the partition wall is discharged.

In the running-water-type evaporator according to an exemplary embodiment of the present invention, the supply groove may be in communication with at least one of the plurality of partition walls to supply a high-temperature fluid to the inside of the partition wall, and wherein the high-temperature fluid supplied to the partition wall may be discharged through the discharge groove after moving to another partition wall that is disposed to be adjacent to the partition wall through the connection groove.

In the running-water-type evaporator according to an exemplary embodiment of the present invention, a pair of the flow plate members may be provided so as to face each other, and wherein each of the flow plate members may include a main groove that protrudes outward.

In the running-water-type evaporator according to an exemplary embodiment of the present invention, the flow plate member may include a first opening hole that is formed to penetrate such that the fluid flowing through the main groove directly contacts the heat transfer surface.

In the running-water-type evaporator according to an exemplary embodiment of the present invention, the inner plate member may include a second opening hole that is formed to penetrate such that the fluid passing through the first opening hole directly contacts the heat transfer surface.

In the running-water-type evaporator according to an exemplary embodiment of the present invention, the flow plate member may include a heat transfer column that protrudes outward along the main groove and makes surface contact with the heat transfer surface, and wherein the first opening hole may be provided at the front end of the heat transfer column.

In the running-water-type evaporator according to an exemplary embodiment of the present invention, a support surface which supports an outer side surface of the heat transfer column in a state where the heat transfer column is inserted may be provided around the periphery of the second opening hole.

In the running-water-type evaporator according to an exemplary embodiment of the present invention, the pair of outer plate members may be provided with the supply grooves, respectively, and wherein the inner plate member may be disposed to be bonded to each of the pair of outer plate members.

In the running-water-type evaporator according to an exemplary embodiment of the present invention, among the pair of flow plate members, any one of the flow plate members may include a coupling piece that is coupled to the other flow plate member.

In the running-water-type evaporator according to an exemplary embodiment of the present invention, among the pair of flow plate members, any one of the flow plate members may include a support piece that is supported in contact with the inner plate member.

In the running-water-type evaporator according to an exemplary embodiment of the present invention, the inner plate member may include a counter piece that is supported in contact with the support piece.

In the running-water-type evaporator according to an exemplary embodiment of the present invention, bonding surfaces that are capable of mutual bonding may be provided around the periphery of the pair of outer plate members, respectively. In the running-water-type evaporator according to an exemplary embodiment of the present invention, bent surfaces that are bent inward may be provided around the periphery of the pair of outer plate members that are disposed to face each other, and wherein the bonding surface may be provided at the front end of the bent surface.

The ice-making device including the running-water-type evaporator according to the present invention may include an ice-making water supply unit for supplying ice-making water for generating ice; a running-water-type evaporator for generating ice while the ice-making water supplied from the ice-making water supply unit flows; and a heat transfer fluid supply unit for supplying a low-temperature fluid or a high-temperature fluid to the inside of the running-water-type evaporator, wherein the running-water-type evaporator includes a pair of outer plate members that are disposed to face each other; and a flow plate member which is disposed between the pair of outer plate members to partition a space between the pair of outer plate members so as to form a first flow path through which a low-temperature fluid for generating ice or a high-temperature fluid for separating the generated ice flows, and wherein the outer plate member includes a heat transfer surface which is formed on the inside to thermally contact the fluid, an ice generating surface which is formed on the outside such that a first surface of ice is formed to be attached thereto, a partition wall which protrudes outward to partition the ice generating surface such that a second surface which is formed to extend from the first surface of ice is attached thereto and extends in a direction crossing the flow direction of the fluid flowing through the first flow path, and a supply groove which protrudes outward to form a second flow path that communicates with the inside of the partition wall such that a high-temperature fluid is supplied to the inside of the partition wall.

The water purification device including the running-water-type evaporator according to the present invention may include a filtering unit for filtering raw water to generate purified water; a running-water-type evaporator for generating ice while the purified water supplied from the filtering unit flows; and a heat transfer fluid supply unit for supplying a low-temperature fluid or a high-temperature fluid to the inside of the running-water-type evaporator, wherein the running-water-type evaporator includes a pair of outer plate members that are disposed to face each other; and a flow plate member which is disposed between the pair of outer plate members to partition a space between the pair of outer plate members so as to form a first flow path through which a low-temperature fluid for generating ice or a high-temperature fluid for separating the generated ice flows, and wherein the outer plate member includes a heat transfer surface which is formed on the inside to thermally contact the fluid, an ice generating surface which is formed on the outside such that a first surface of ice is formed to be attached thereto, a partition wall which protrudes outward to partition the ice generating surface such that a second surface which is formed to extend from the first surface of ice is attached thereto and extends in a direction crossing the flow direction of the fluid flowing through the first flow path, and a supply groove which protrudes outward to form a second flow path that communicates with the inside of the partition wall such that a high-temperature fluid is supplied to the inside of the partition wall.

Advantageous Effects

According to the above configurations, the running-water-type evaporator according to the present invention provides the effect of improving the cleanliness of ice-making water by being configured to minimize the degree of ice melting during ice separation and circulating the ice-making water while flowing only to the outer sides of a pair of outer plate members, because during ice separation, the heat supplied through a high-temperature fluid is evenly transferred to ice such that the ice can be easily separated without using separate ice-separating.

The running-water-type evaporator according to an exemplary embodiment of the present invention provides the effect of improving structural stability by preventing a high-temperature fluid from leaking into a pair of outer plate members, because the supply groove and the partition wall are closed as the outer plate member and the inner plate member are disposed to be coupled to each other.

The running-water-type evaporator according to an exemplary embodiment of the present invention provides the effect of improving user convenience by being configured to generate ice at each location where a low-temperature fluid flows and generate several ices at the same time in the process of flowing ice-making water between the adjacent partition walls.

The running-water-type evaporator according to an exemplary embodiment of the present invention provides the effect of improving productivity through a simplified configuration by being configured to supply a high-temperature fluid to all of a plurality of partition walls even when the high-temperature liquid is suppled to any one of the partition walls, as connecting grooves are formed such that the partition walls communicate with each other.

The running-water-type evaporator according to the embodiment of the present invention provides the effect of improving the structural stability of a main groove by configuring a low-temperature fluid to move through the main groove that is formed in a pair of flow plate members.

The running-water-type evaporator according to an exemplary embodiment of the present invention provides the effect of improving user satisfaction by being configured such that a low-temperature fluid moves through the main groove, and heat is transferred in the process of direct contact of the low-temperature fluid to the heat transfer surface through a first opening hole, thereby improving ice-making performance and easily separating ice during ice separation.

The running-water-type evaporator according to an exemplary embodiment of the present invention provides the effect of improving user satisfaction, because the inner plate member is disposed to be bonded to the heat transfer surface to prevent a high-temperature fluid from leaking into a pair of outer plate members, and at the same time, while the low-temperature fluid passing through the first opening hole sequentially passes through a second opening hole, it not only improves ice making performance by directly contacting the heat transfer surface, but also easily separates ice during ice separation.

The running-water-type evaporator according to an exemplary embodiment of the present invention provides the effect of improving user satisfaction through improved ice making performance and quick separation of ice, because the heat transfer column is in surface contact with the heat transfer surface, thereby improving the heat transfer performance, and the first opening hole is formed at the front end of the heat transfer column such that the low-temperature fluid directly contacts the heat transfer surface.

The running-water-type evaporator according to an exemplary embodiment of the present invention provides the effect of improving structural stability, because the outer side surface of the heat transfer column is supported by the support surface that is formed in the second opening hole while the heat transfer column is inserted into the second opening hole such that the flow plate member and the inner plate member can be assembled to each other at the correct position during the assembly process, and ensures that the assembly state between these members is stably maintained after assembly.

The running-water-type evaporator according to an exemplary embodiment of the present invention provides the effect of improving user satisfaction through the quick separation of ice, because the inner plate members are disposed to be bonded to each other while supply grooves are formed in a pair of outer plate members, respectively, and a high-temperature fluid is supplied independently of each other.

The running-water-type evaporator according to an exemplary embodiment of the present invention provides the effect of improving structural stability by stably coupling a pair of flow plate members to each other through a coupling piece.

The running-water-type evaporator according to an exemplary embodiment of the present invention provides the effect of improving structural stability, because the assembled state between the flow plate member and the inner plate member is stably maintained, as the support piece that is formed on the flow plate member and the counter piece that is formed on the inner plate member are supported in contact with each other.

The running-water-type evaporator according to an exemplary embodiment of the present invention provides the effect of preventing degradation in the cleanliness of ice-making water, because bonding surfaces are provided around the periphery of a pair of outer plate members to seal the inner sides of a pair of outer plate members such that the air or ice-making water does not flow therein.

The running-water-type evaporator according to an exemplary embodiment of the present invention provides the effect of improving manufacturing easiness, because it is possible to secure an internal space in which the flow plate member can be placed by forming bent surfaces on the pair of outer plate members, respectively.

The ice-making device including the running-water-type evaporator according to the present invention provides the effect of improving the cleanliness of ice-making water, because an ice-making water supply unit for supplying ice-making water and a heat transfer fluid supply unit for supplying a low-temperature fluid or a high-temperature fluid to the inside of the evaporator are provided to generate ice, and during ice separation, the heat supplied through the high-temperature fluid is evenly formed into ice, and since the ice can be easily separated without using separate ice-separating water, the degree of ice melting during ice separation is minimized, and it is configured such that the ice-making water circulates while flowing only to the outer sides of a pair of plate members.

The water purification device including the running-water-type evaporator according to the present invention provides the effect of improving the cleanliness of ice-making water, because raw water is filtered to generate purified water, and the generated purified water is supplied to generate ice, and during ice separation, the heat supplied through a high-temperature fluid is evenly transferred to the ice, and since the ice can be easily separated without using separate ice-separating water, the degree of ice melting during ice separation is minimized, and also, it is configured such that the ice-making water circulates while flowing only to the outer sides of a pair of plate members.

MODES OF THE INVENTION

Figure 1:
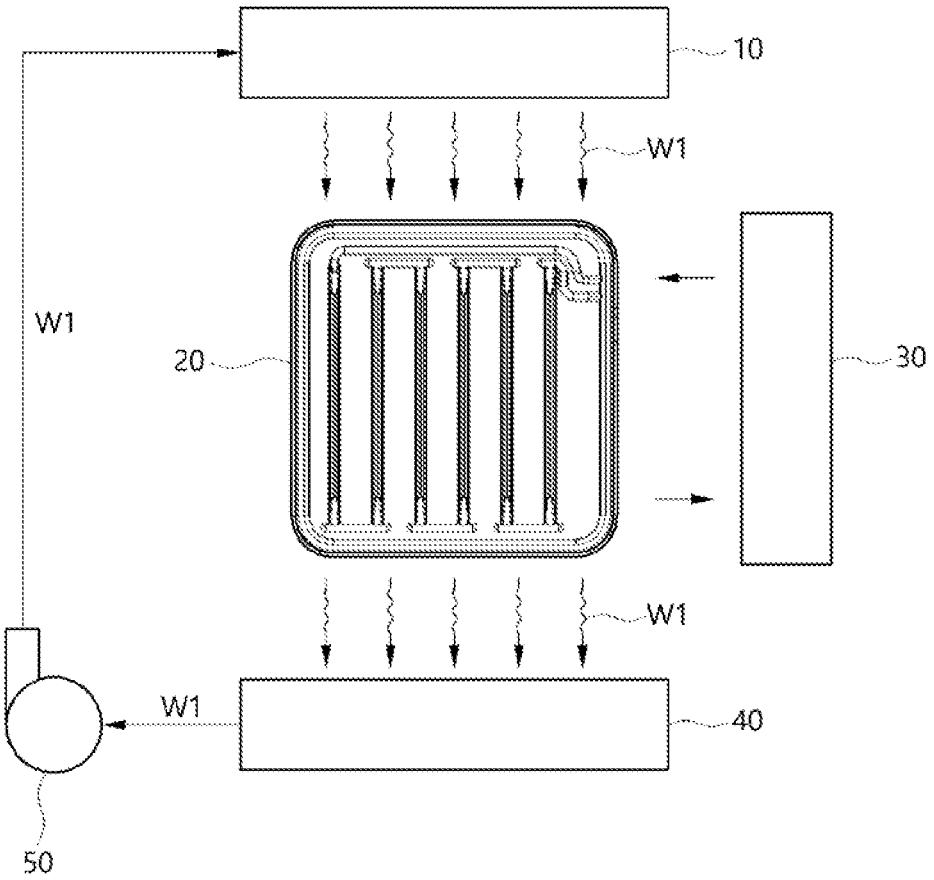
FIG. 1 is a block diagram of an ice-making device including the running-water-type evaporator according to an exemplary embodiment of the present invention.

Terms and words used in the present specification and claims should not be construed as limited to their usual or dictionary definition, and they should be interpreted as a meaning and concept consistent with the technical idea of the present invention based on the principle that inventors may appropriately define the terms and concept in order to describe their own invention in the best way Accordingly, the exemplary embodiments described in the present specification and the configurations shown in the drawings correspond to preferred exemplary embodiments of the present invention, and do not represent all the technical spirit of the present invention, and thus, the configurations may have various examples of equivalent and modification that can replace them at the time of filing the present invention.

It is understood that the terms "include" or "have", when used in the present specification, are intended to describe the presence of stated features, integers, steps, operations, elements, components and/or a combination thereof but not preclude the possibility of the presence or addition of one or more other features, integers, steps, operations, elements, components or a combination thereof.

The presence of an element in/on "front", "rear", "upper or above or top" or "lower or below or bottom" of another element includes not only being disposed in/on "front", "rear", "upper or above or top" or "lower or below or bottom" directly in contact with other elements, but also cases in which another element being disposed in the middle, unless otherwise specified. In addition, unless otherwise specified, that an element is "connected" to another element includes not only direct connection to each other but also indirect connection to each other.

Hereinafter, the running-water-type evaporator, the ice-making device and the water purification device including the same according to the present invention will be described with reference to the drawings. Herein, the X direction is the width direction of the running-water-type evaporator, the Y direction is the depth direction of the running-water-type evaporator, and the Z direction is the height direction of the running-water-type evaporator, which means the direction in which ice-making water flows due to gravity. In order to clearly describe the present invention, parts that are not related to the description are omitted from the drawings.

FIG. 1 is a block diagram of an ice-making device including the running-water-type evaporator according to an exemplary embodiment of the present invention.

As illustrated in FIG. 1, the ice-making device including the running-water-type evaporator according to the present invention may include an ice-making water supply unit 10 for supplying ice-making water W1 for generating ice, a running-water-type evaporator 20 in which ice C is generated while the ice-making water W1 supplied from the ice-making water supply unit flows, and a heat transfer fluid supply unit 30 for supplying a low-temperature fluid or a high-temperature fluid to the inside of the running-water-type evaporator 20. The ice-making water supply unit 10 may use water supplied from the outside as the ice-making water W1, or circulate the ice-making water W1 via the running-water-type evaporator 20. To this end, a water tank for collecting the ice making water W1 passing through the running-water-type evaporator 20 may be provided, and a pump 50 for circulating the ice making water W1 collected in the water tank 40 to the ice making water supply unit 10 may be provided. The ice-making water supply unit 10 may distribute and supply the ice-making water W1 evenly along the width direction X of the running-water-type evaporator 20. Alternatively, the ice-making water W1 may be supplied by using a separate guide for distributing the ice-making water W1. A low-temperature fluid for ice generation and a high-temperature fluid for ice separation may flow inside the evaporator 20, and a heat transfer fluid supply unit 30 for supplying the low-temperature fluid or high-temperature fluid from the outside may be provided. The detailed configurations of the running-water-type evaporator 20 provided in the ice-making device will be described below.

The high-temperature fluid means a liquid or gas having a temperature for separating the generated ice C from the evaporator 20, and a fluid having a temperature higher than the temperature of the ice-making water W1 may be used. For example, a liquid or fluid having a temperature of room temperature may be used, and in the case of a liquid, a fluid having a temperature of about 10° C. or higher may be used, and in the case of a gas, a fluid having a temperature of about 30° C. or higher may be used. In addition, as a refrigerant used in the refrigerating cycle, it is also possible to use a refrigerant that is heated to about 50° C. or higher during the operation of the refrigerating cycle as a high-temperature fluid.

Figure 2:
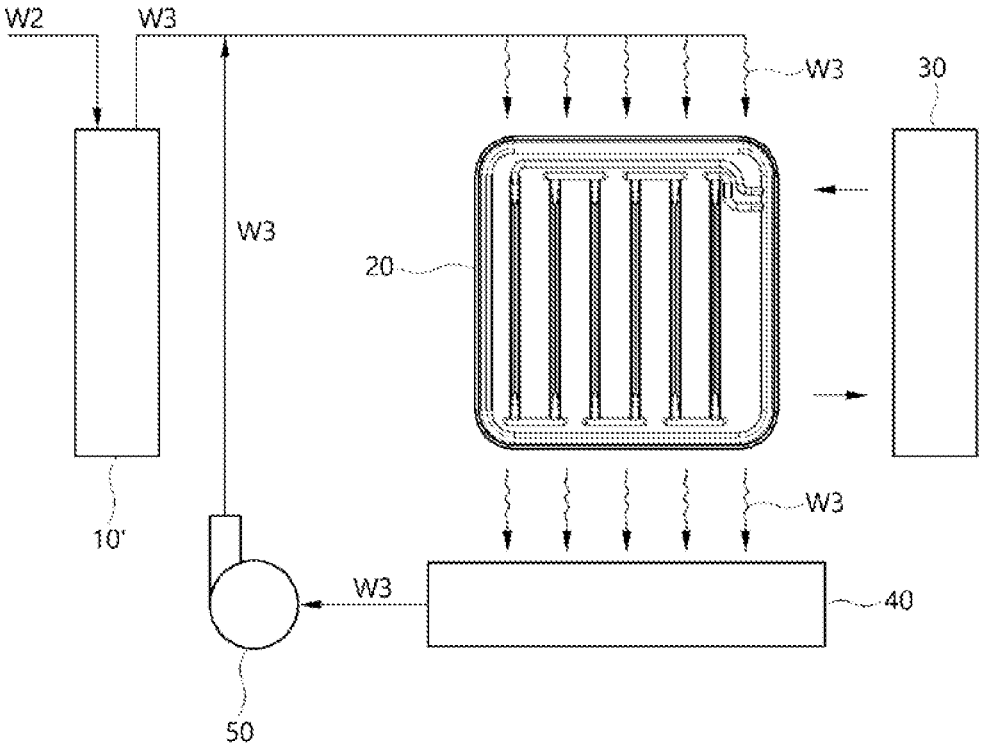
FIG. 2 is a block diagram of a water purification device including the running-water-type evaporator according to an exemplary embodiment of the present invention.

FIG. 2 is a block diagram of a water purification device including the running-water-type evaporator according to an exemplary embodiment of the present invention.

As illustrated in FIG. 2, the water purification device including the running-water-type evaporator according to the present invention may include a filtering unit 10' for generating purified water W3 by filtering raw water W2, a running-water-type evaporator 20 for generating ice C while the purified water W3 supplied from the filtering unit 10' flows, and a heat transfer fluid supply unit 30 for supplying a low-temperature fluid or a high-temperature fluid to the inside of the evaporator 20. The filtering unit 10' receives raw water W2 from the outside, and then filters the raw water W2 to generate purified water W3. The filtering unit 10' may include several filters. For example, the filtering unit 10' may include a pre-carbon filter, a membrane filter and an after-carbon filter. In addition, the filtering unit 10' may include an electric deionization type filter. Electrodeionization methods refer to EDI (Electro Deionization), CEDI (Continuous Electro Deionization), CDI (Capacitive Deionization) and the like. The purified water W3 generated in the filtering unit 10' may be directly supplied to the running-water-type evaporator 20, or may be supplied to a separate storage unit for storing the purified water W3, and the running-water-type evaporator 20 may be configured such that the purified water W3 can be supplied through the storage unit. A low-temperature fluid for ice generation and a high-temperature fluid for ice separation flow inside the evaporator 20, and a heat transfer fluid supply unit 30 for supplying the low-temperature fluid or high-temperature fluid from the outside may be provided. The detailed configuration of the running-water-type evaporator 20 provided in such a water purification device will be described below.

Figure 3:
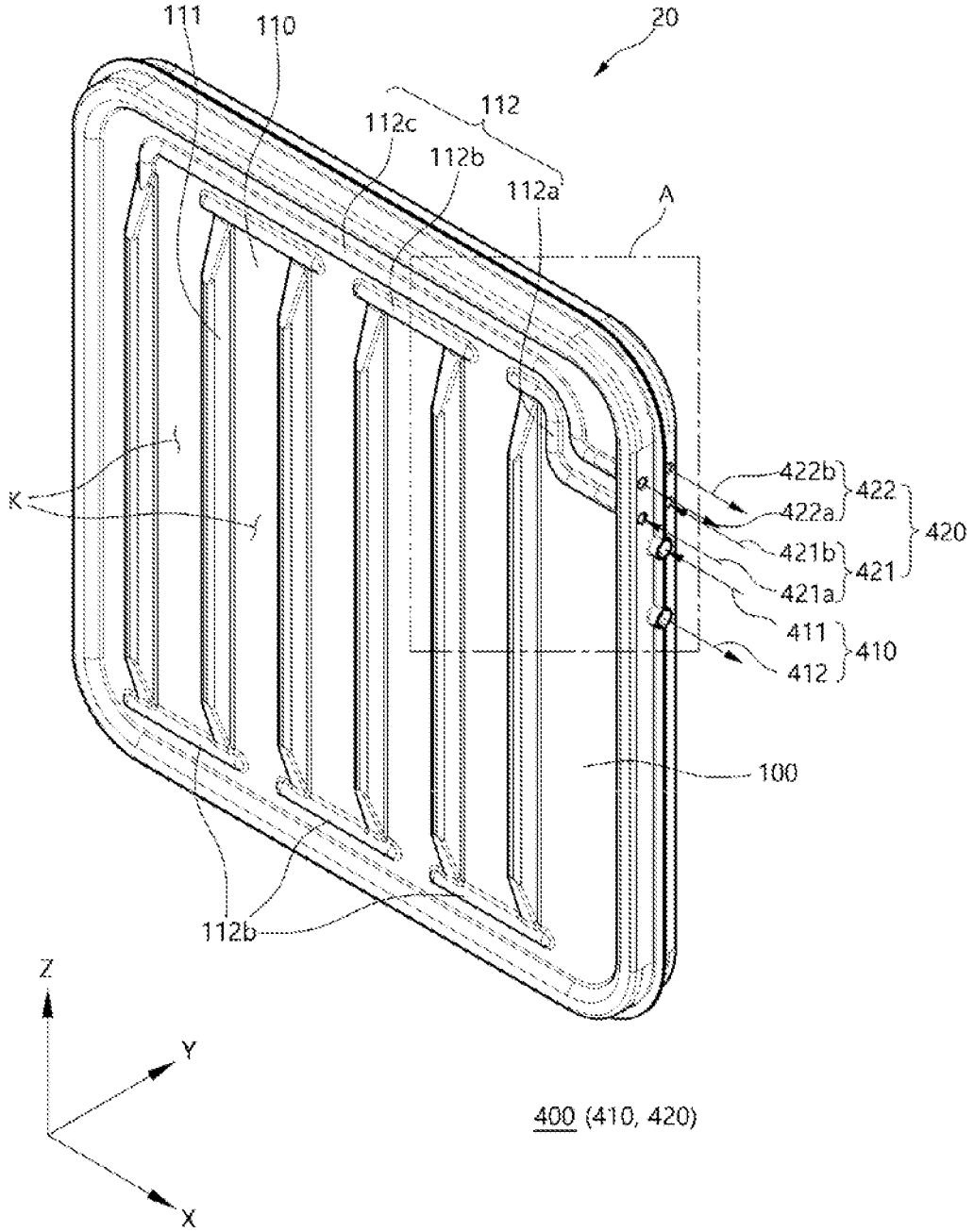
FIG. 3 is a perspective view of the running-water-type evaporator according to an exemplary embodiment of the present invention.
Figure 4:
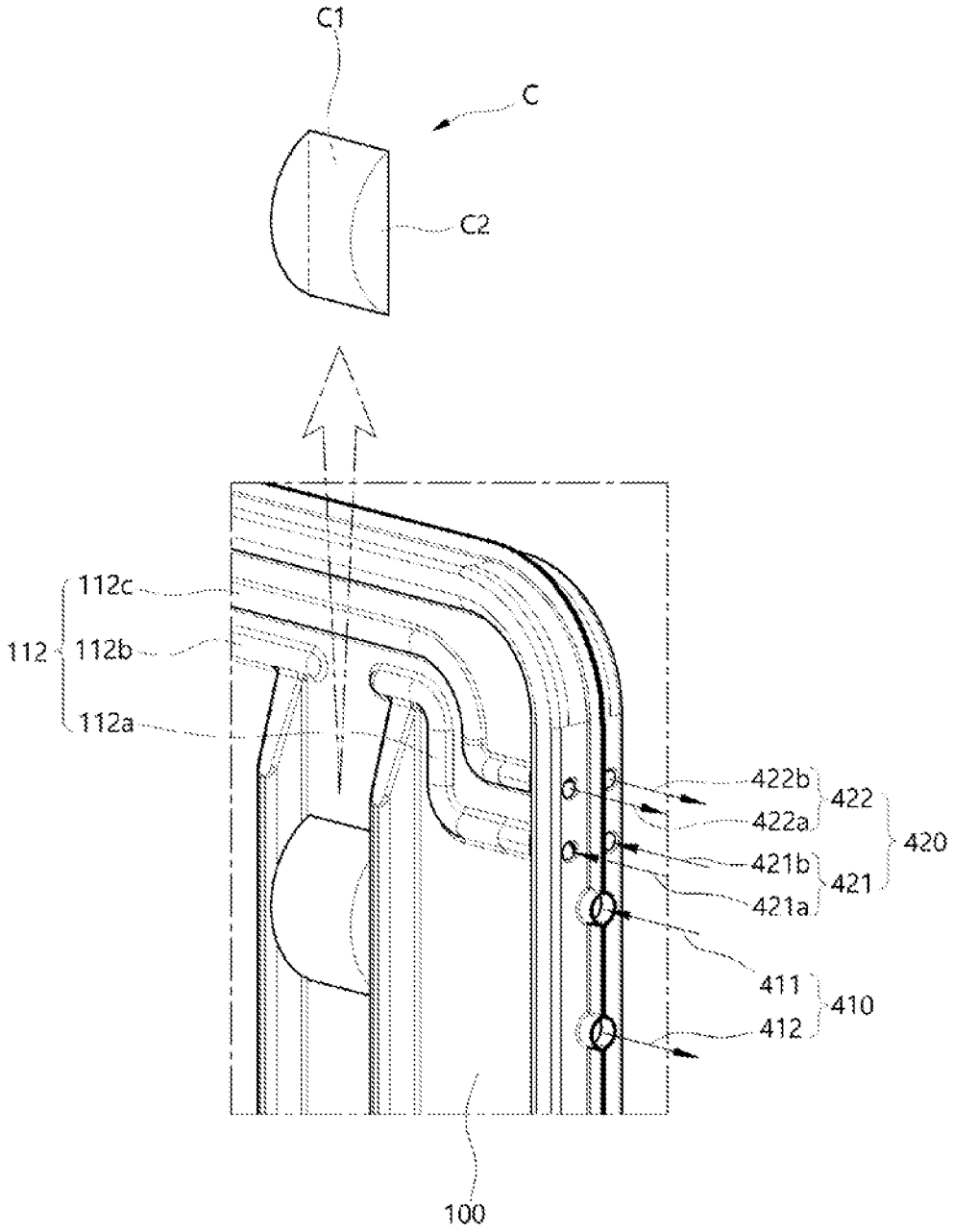
FIG. 4 is an enlarged view of part A of FIG. 3.
Figure 5:
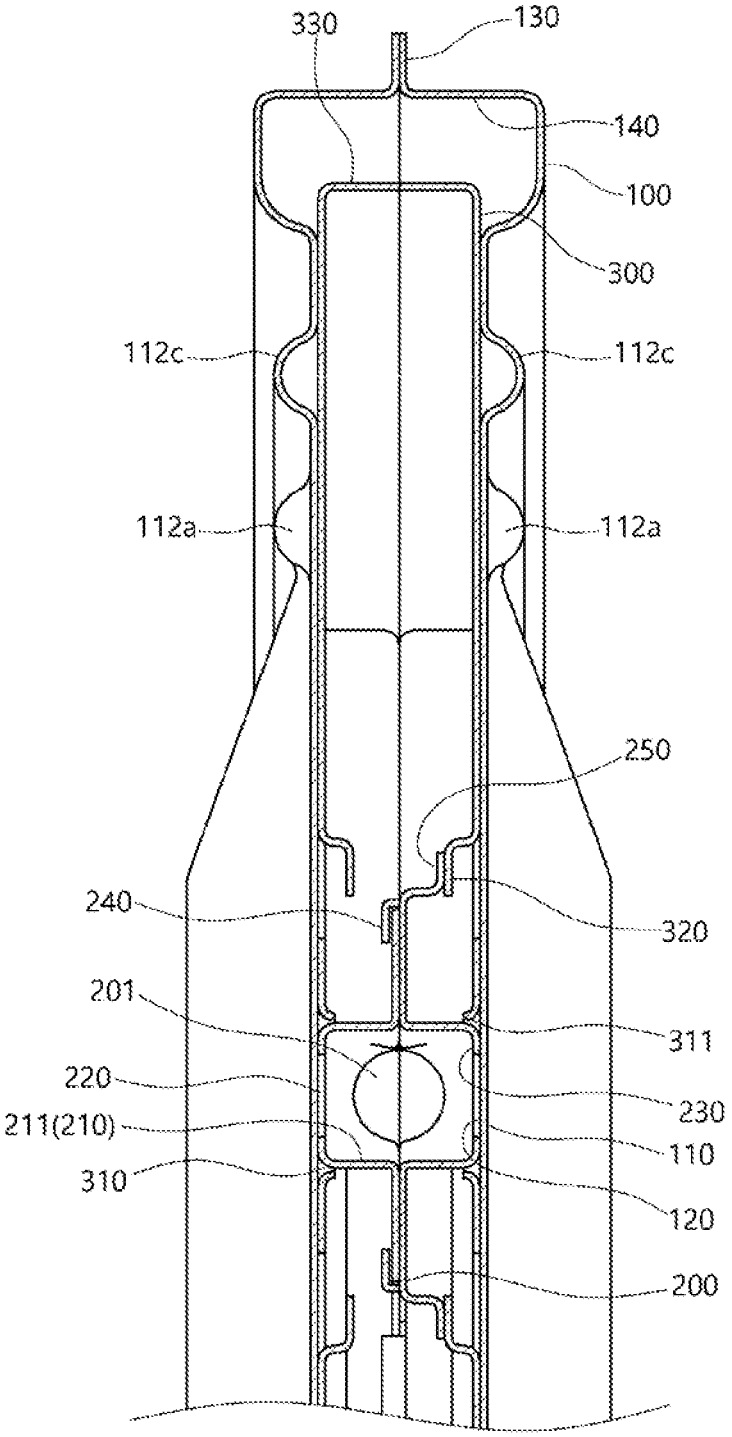
FIG. 5 is a cross-sectional view of the running-water-type evaporator according to an exemplary embodiment of the present invention.

FIG. 3 is a perspective view of the running-water-type evaporator according to an exemplary embodiment of the present invention, FIG. 4 is an enlarged view of part A of FIG. 3, and FIG. 5 is a cross-sectional view of the running-water-type evaporator according to an exemplary embodiment of the present invention.

As illustrated in FIGS. 3 to 5, the running-water-type evaporator according to an exemplary embodiment of the present invention may include a pair of outer plate members 100 that are disposed to face each other, and a flow plate member 200 which is disposed between the pair of outer plate members 100 so as to form a first flow path 201 such that a low-temperature fluid for generating ice or a high-temperature fluid for separating generated ice flows. The outer plate member 100 may include a heat transfer surface 120 which is formed on the inside to thermally contact the fluid, an ice generating surface 110 which is formed on the outside such that a first surface C1 of ice C is formed to be attached thereto, a partition wall 111 which protrudes outward to partition the ice generating surface 110 such that a second surface C2 which is formed to extend from the first surface C1 of ice C is attached thereto and extends in a direction crossing the flow direction of the fluid flowing through the first flow path 201, and a supply groove 112*a* which protrudes outward to form a second flow path 112 that communicates with the inside of the partition wall 111 such that a high-temperature fluid is supplied to the inside of the partition wall 111.

In this case, the outer sides of the pair of outer plate members 100 mean parts where ice C is generated while the ice-making water W1 flows, and the inner sides of the pair of outer plate members 100 mean parts where they thermally contact with the flow plate member 200. The ice-making water W1 includes purified water W3 that is filtered while passing through the filtering unit 10'. On the ice generating surface 110, in order to partition an area K where the ice C is generated, the partition wall 111 which extends in a direction crossing the flow direction of the fluid flowing through the first flow path 210 is formed to protrude outward of the pair of outer plate members 100. That is, the ice-making water W1 supplied to the running-water-type evaporator flows along the outer sides of the pair of outer plate members 100 in a state of being distributed by the partition wall 111, and ice C is generated at a part that thermally contacts the flow plate member 200.

As illustrated in FIG. 3, the outer plate member 100 may be provided with an inlet and outlet port 400 for supplying and discharging a low-temperature fluid and a high-temperature fluid. The inlet and outlet port 400 may include a main fluid port 410 to which a low-temperature fluid is supplied and discharged, and a high-temperature fluid port 420 to which a high-temperature fluid is supplied and discharged. The main fluid port 410 supplies and discharges a low-temperature fluid during ice making, but supplies and discharges a high-temperature fluid during ice separation. The main fluid port 410 may include a main fluid supply port 411 and a main fluid discharge port 412, and the high-temperature fluid port 420 may include a high-temperature fluid supply port 421 and a high-temperature fluid discharge port 422. In this case, high-temperature fluid ports 420 may be formed in the pair of outer plate members 100, respectively. That is, the above-described high-temperature fluid supply port 421 may include a first high-temperature fluid supply port 421*a* that is formed on any one of the outer plate members 100 and a second high-temperature fluid supply port 421*b* that is formed on the other one of the outer plate members 100, and the high-temperature fluid discharge port 422 may include a first high-temperature fluid discharge port 422*a* that is formed on any one of the outer plate members 100 and a second high-temperature fluid discharge port 422*b* that is formed on the other one of the outer plate members 100.

As illustrated in FIG. 4, the first surface C1 of the generated ice C is attached to the ice formation surface 110, and the second surface C2 which is formed to extend from the first surface C1 is formed to be attached to the outer side surface of the partition wall 111. That is, as the ice-making water W1 flows, ice C is first generated on the ice-forming surface 110, and in this case, the first surface C1 of the ice C is attached to the ice-forming surface 110. When the ice-making water W1 continues to flow in this state, the size of the ice C increases and ice is also formed on the outer surface of the partition wall 111, and in this case, the second surface C2 of the ice C becomes attached to the outer side surface of the partition wall 111. Therefore, in order to separate the ice, it is necessary to quickly separate the first side C1 and the second side C2 of the ice C. To this end, a high-temperature fluid may be supplied to the inside of the flow plate member 200, and as illustrated in FIG. 5, heat which is supplied through the high-temperature fluid flowing through the flow plate member 200 is transferred to the heat transfer surface 120 and the ice via the ice generating surface 100 such that the first surface C1 is separated from the ice generating surface 110. Moreover, at the same time, the high-temperature fluid supplied through the supply groove 112*a* moves to the inside of the partition wall 111 through the second flow path 112, and is transferred to the partition wall 111 through the high-temperature fluid flowing through the partition wall 111 such that the second surface C2 may be configured to be separated from the partition wall 111. That is, heat supplied through the high-temperature fluid flowing through the flow plate member 200 and the high-temperature fluid flowing inside the partition wall 111 of the outer plate member 100 during ice separation is evenly transferred to the ice C such that the ice C can be easily separated without using the ice separation water, and thus, the degree of melting of the ice C during ice separation is minimized. In addition, since the ice-making water W1 is configured to circulate while flowing only to the outer sides of the pair of outer plate members 100, it is possible to effectively prevent the degradation in cleanliness of the ice C as well as the circulating ice-making water W1.

As illustrated in FIG. 5, the running-water-type evaporator according to an exemplary embodiment of the present invention may further include an inner place member 300 which is disposed to be bonded to the heat transfer surface 120 so as to prevent the fluid flowing inside the supply groove 112*a* and the partition wall 111 from leaking into a space between the pair of outer plate members. In order to bond and arrange the inner plate member 300 to the heat transfer surface 120 as described above, a clad material may be disposed between the outer plate member 100 and the inner plate member 300. In this case, as the clad material, the clad material may be sprayed to form a clad layer, or a clad sheet may be used. In a state where the clad material is disposed between the outer plate member 100 and the inner plate member 300, mutual bonding is possible through a brazing process, and through this, the supply groove 112*a* and the partition wall 111 are closed such that structural stability can be secured by preventing a high-temperature fluid from leaking into the inner sides of the pair of outer plate members 100. In this case, bending ribs 330 that are formed to extend inward in the depth direction Y may be formed around the periphery of the pair of inner plate members 300 that are disposed to face each other. When the bending ribs 330 are formed in this way, since the separation distance between the pair of inner plate members 300 is stably maintained, it can be stably bonded to the heat transfer surface 120 of the outer plate member 100 during the brazing process, and it is possible to easily secure a space in which the flow plate member 200 is located between the pair of inner plate members 300.

As illustrated in FIG. 3, the running-water-type evaporator according to the embodiment of the present invention may further include a connection groove 112*b* such that the partition wall 111 is formed to extend parallel to a direction in which the ice-making water W1 flows and a plurality of partition walls 111 are disposed to be spaced apart at regular intervals, and a discharge groove 112*c* through which the fluid flowing inside the partition wall 111 is discharged. That is, since the connection groove 112*b* is formed and the partition walls 111 communicate with each other, even when a high-temperature fluid is supplied to any one of the partition walls 111, all of the high-temperature fluid can be supplied to the plurality of partition walls 111, and thus, the configuration of the running-water-type evaporator can be simplified as a whole, and in the process of the ice making water W1 flowing between the adjacent partition walls 111, ice C is created at each location where the low-temperature fluid flows, and it is possible to improve use convenience because multiple ices can be generated at the same time.

In this case, in the running-water-type evaporator according to the embodiment of the present invention, the supply groove 112*a* communicates with at least one partition wall 111 among the plurality of partition walls 111 to supply a high-temperature fluid into the partition wall 111, and the high-temperature fluid supplied to the partition wall 111 moves to another partition wall 111 that is disposed adjacent to the partition wall 111 through the above-described connection groove 112*b*, and then it may be configured to be discharged through the discharge groove 112*c*. That is, when a high-temperature fluid is supplied to the plurality of partition walls 111, the second flow path 112 may be configured in series such that the high-temperature fluid moves sequentially through the plurality of partition walls 111, or the second flow path 112 may be configured in parallel such that the high-temperature fluid moves through the plurality of partition walls 111 at the same time. When the connection groove 112*b* is formed in this way, even when a high-temperature fluid is supplied to any one of the partition walls 111 while the partition walls 111 communicate with each other, the high-temperature fluid can be supplied to all of the partition walls 111, and thus, the configuration may be simplified, and through this, it is possible to improve productivity.

Figure 6:
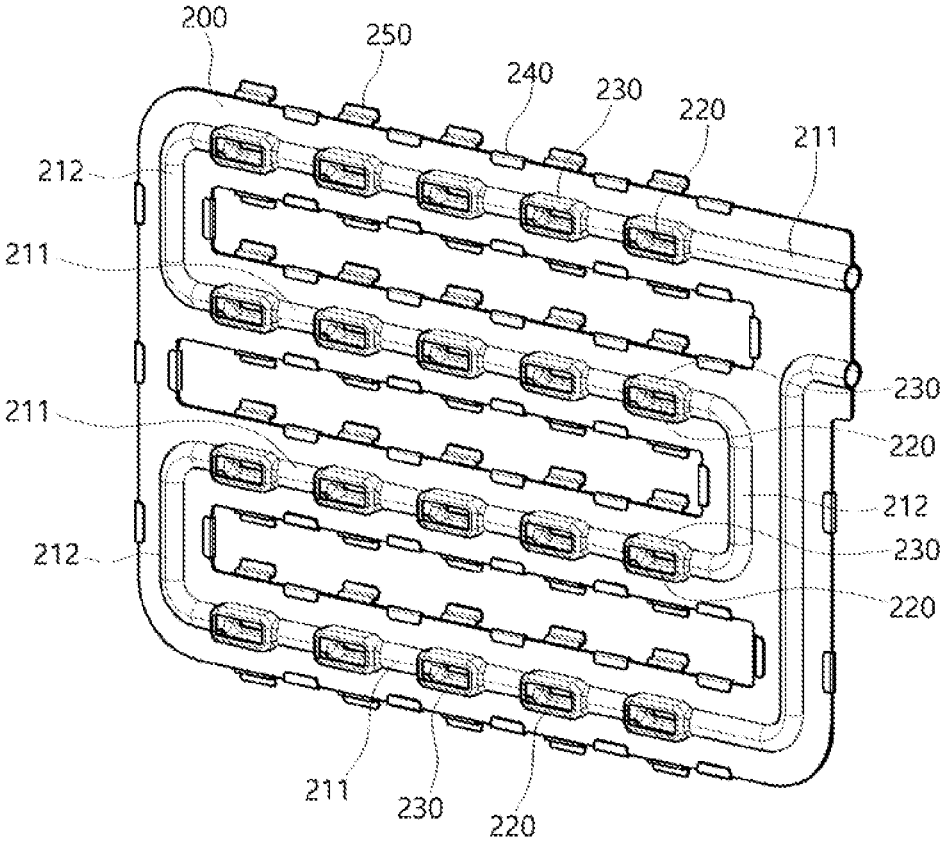
FIG. 6 is a perspective view illustrating the assembled state of a pair of flow plate members according to an exemplary embodiment of the present invention.
Figure 7:
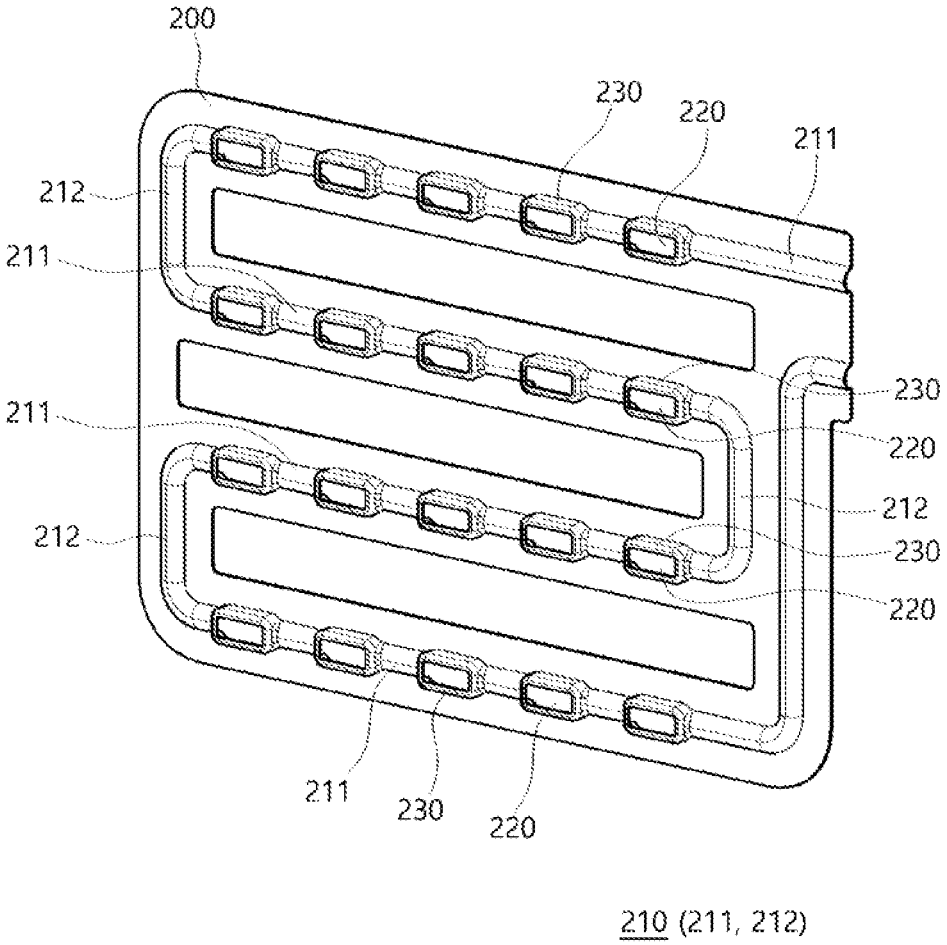
FIG. 7 is a perspective view illustrating any one of flow plate members according to an exemplary embodiment of the present invention.
Figure 8:
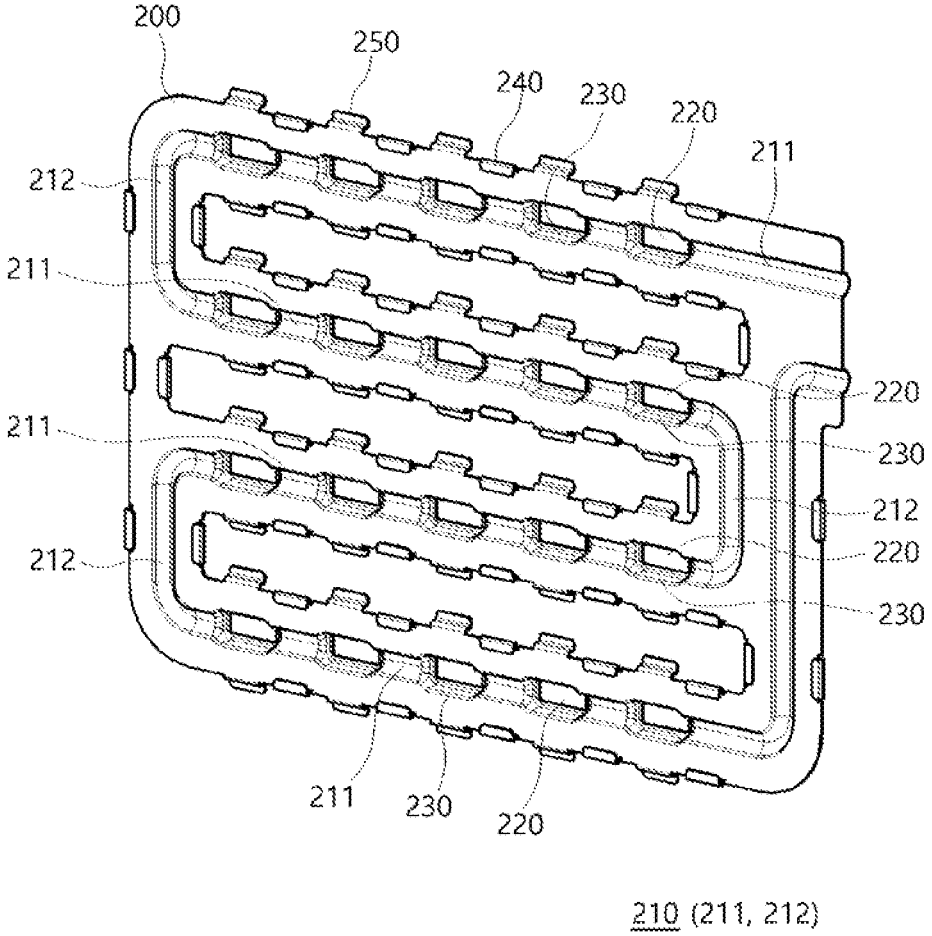
FIG. 8 is a perspective view illustrating the other one of flow plate members according to an exemplary embodiment of the present invention.

FIG. 6 is a perspective view illustrating the assembled state of a pair of flow plate members according to an exemplary embodiment of the present invention, FIG. 7 is a perspective view illustrating any one of flow plate members according to an exemplary embodiment of the present invention, and FIG. 8 is a perspective view illustrating the other one of flow plate members according to an exemplary embodiment of the present invention.

As illustrated in FIGS. 6 to 8, in the running-water-type evaporator according to an exemplary embodiment of the present invention, a pair of the flow plate members 200 may be provided to face each other, and each flow plate member 200 may include a main groove 210 that protrudes in the outward direction. A low-temperature fluid flows during ice making, and a high-temperature fluid flows during ice separation through the main groove 210, and as the main groove 210 is formed in the pair of flow plate members 200, the structural stability of the main groove 210 is improved, and the position of the flow plate member 200 inside the outer plate member 100 can be stably fixed. The main groove 210 includes a heat transfer groove 211 that exchanges heat with the heat transfer surface 120 while extending along the width direction X. In this case, at least one of these heat transfer grooves 211 may be disposed along the height direction Z, and through this, ice C may be generated at a plurality of positions along the height direction Z. Moreover, the main groove 210 may further include a communication groove 212 for communicating the heat transfer grooves 211 with each other.

In the running-water-type evaporator according to an exemplary embodiment of the present invention, the flow plate member 200 may include a first opening hole 220 that is formed to penetrate such that the fluid flowing through the main groove 210 directly contacts the heat transfer surface 120. That is, since it is configured such that in the process of the low-temperature fluid or the high-temperature fluid flowing along the main groove to physically directly contact the heat transfer surface 120 through the first opening hole 220, heat is transferred, it is possible to improve ice making performance, and the ice can be easily separated during ice separation. In addition, since the size and shape of ice C can be maintained, it is possible to improve user satisfaction.

In this case, as described above, since the inner plate member 300 is disposed to be bonded to the heat transfer surface 120 that is formed on the outer plate member 100, even if the first opening hole 220 is formed in the main groove 210, the inner plate member, if a low-temperature fluid or a high-temperature fluid cannot directly contact the heat transfer surface 120 due to the inner plate member 300, the inner plate member 300 acts as a thermal resistance, and thus, ice-making or ice-separating performance may deteriorate. In order to prevent this, in the running-water-type evaporator according to an exemplary embodiment of the present invention, the inner plate member 300 may include a second opening 310 that is formed to penetrate such that the fluid passing through the first opening 220 directly contacts the heat transfer surface 120. That is, the inner plate member 300 is disposed to be bonded to the heat transfer surface 120 to prevent the high-temperature fluid flowing inside the partition wall 111 from leaking into the pair of outer plate members 100, and at the same time, the low-temperature fluid or high-temperature fluid passing through the first opening hole 220 sequentially passes through the second opening hole 310 and physically directly contacts the heat transfer surface 120 such that the ice making performance is improved, since the ice can be easily separated during ice separation, it is possible to improve user satisfaction.

As illustrated in FIG. 6, in the running-water-type evaporator according to an exemplary embodiment of the present invention, the flow plate member 200 may include a heat transfer column 230 that protrudes outward along the main groove 210 and makes surface contact with the heat transfer surface 120, and in this case, the first opening hole 220 may be provided at the front end of the heat transfer column 230. As such, since the heat transfer column 230 is in surface contact with the heat transfer surface 120, the heat transfer performance is improved, and thus, when a low-temperature fluid flows, the ice-making performance is improved, and when a high-temperature fluid flows, the ice C can be smoothly separated. In addition, structural stability may be improved through surface contact between the heat transfer column 230 and the heat transfer surface 120. Moreover, since it is configured such that the first opening hole 220 is formed at the front end of the heat transfer column 230 such that a low-temperature fluid or a high-temperature fluid is in direct contact with the heat transfer surface 120, it is possible to improve the ice making performance and improve user satisfaction by the quick separation of ice.

Figure 9:
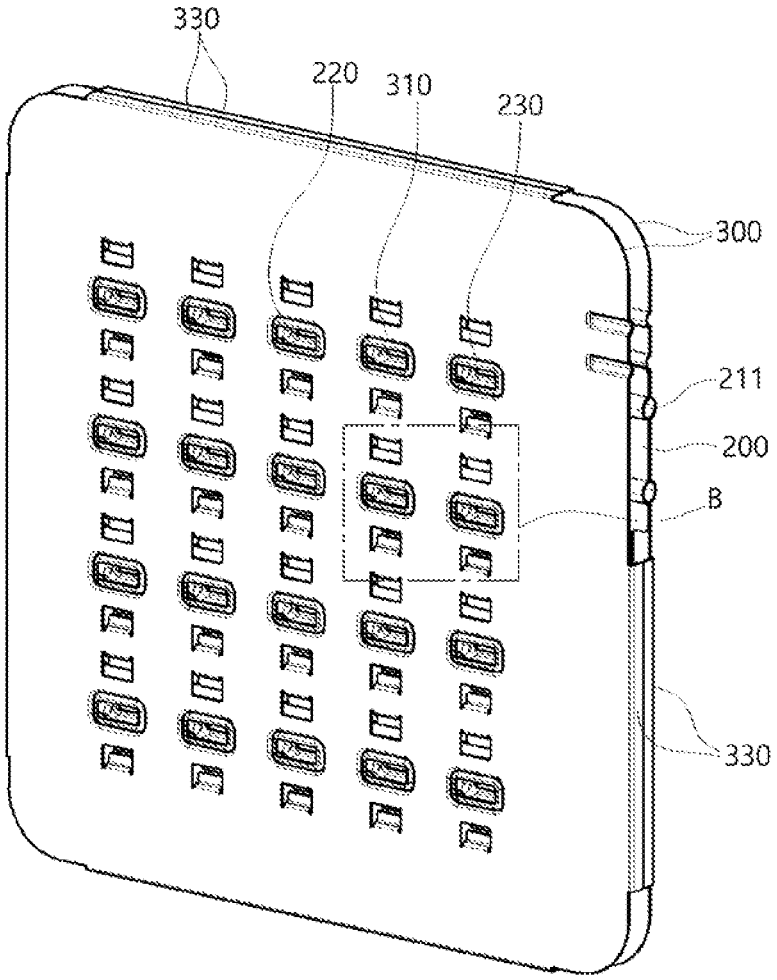
FIG. 9 is a perspective view illustrating the assembled state of an inner plate member and a flow plate member according to an exemplary embodiment of the present invention.
Figure 10:
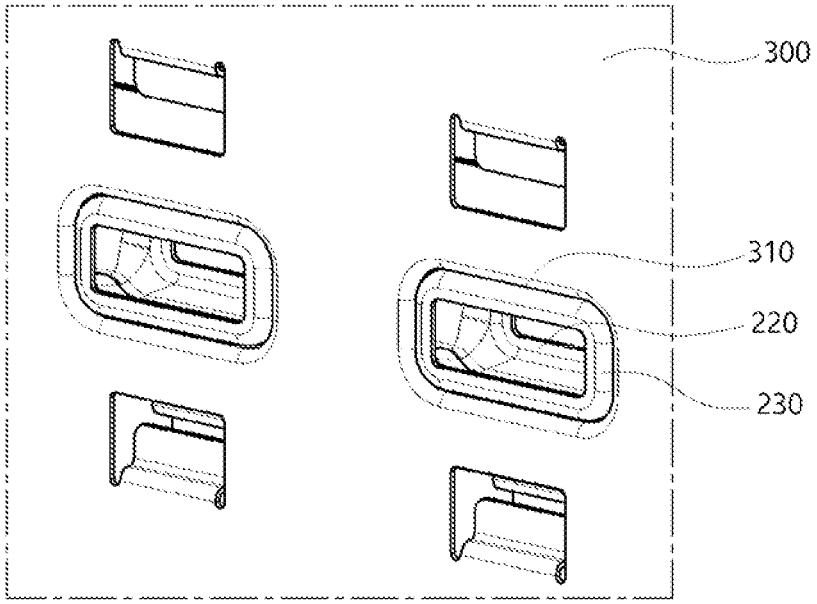
FIG. 10 is an enlarged view of part B of FIG. 9.

FIG. 9 is a perspective view illustrating the assembled state of an inner plate member and a flow plate member according to an exemplary embodiment of the present invention, and FIG. 10 is an enlarged view of part B of FIG. 9.

As illustrated in FIGS. 9 and 10, the front end of the heat transfer column 230 is disposed to be inserted into the second opening hole 310 that is formed on the inner plate member 300. In this case, as illustrated in FIG. 5, in the running-water-type evaporator according to the embodiment of the present invention, a support surface 311 that supports the outer side surface of the heat transfer column 230 while the heat transfer column is inserted may be provided around the periphery of the second opening hole 310. That is, since the heat transfer column 230 is disposed to be inserted into the second opening hole 310, the low-temperature fluid or high-temperature fluid flowing through the main groove 210 can exchange heat while stably contacting the heat transfer surface 120. In addition, since the outer side surface of the heat transfer column 230 is supported by the support surface 311 that is formed on the second opening hole 310, the flow plate member 200 and the inner plate member 300 may be assembled at each other in the correct position during the assembly process. After assembling, the assembly state between these members is stably maintained such that structural stability can be secured even when it is used for a long period of time.

As illustrated in FIG. 5, in the running-water-type evaporator according to an exemplary embodiment of the present invention, the pair of outer plate members 100 may be provided with a supply groove 112*a*, respectively, and the inner plate members 300 may be disposed to be bonded to the pair of outer plate members 100. As illustrated in FIG. 4, on this outer plate member 100, a supply groove 112*a* as well as a connection groove 112*b* and a discharge groove 112*c* may be formed, respectively, and a high-temperature fluid supply port 421 that communicates with each supply groove 112*a* and a high-temperature fluid discharge port 422 that communicates with each discharge groove 112 may be respectively provided. As described above, when the inner plate members 300 are disposed to be bonded and a high-temperature fluid is supplied independently of each other while the supply grooves 112*a* are forced in the pair of outer plate members 100, respectively, the ice C formed on the ice generating surfaces 110 of the pair of outer plate members 100 may be quickly separated to improve user satisfaction.

As illustrated in FIG. 5, in the running-water-type evaporator according to an exemplary embodiment of the present invention, any one of the pair of flow plate members 200 may include a coupling piece 240 that is coupled to the other one of the flow plate members 200. As an example, the coupling piece 240 may be formed to be bent to surround a part of the periphery of the other one of the flow plate members 200, but the present invention is not necessarily limited to such a shape, and any shape is possible as long as it can prevent relative movement of the pair of flow plate members 200. As such, when the pair of flow plate members 200 are configured to be coupled to each other through the coupling piece 240, it is possible to secure structural stability.

Meanwhile, as illustrated in FIG. 5, in the running-water-type evaporator according to an exemplary embodiment of the present invention, any one of the pair of flow plate members 200 may include a support piece 250 that is supported in contact with the inner plate member 300. The support piece 250 may be formed to extend by a certain distance so as to be in surface contact with the inner plate member 300 in the width direction X or in the height direction Z while being formed to extend by a certain distance outward in the depth direction Y toward the inner plate member 300. Further, in the running-water-type evaporator according to an exemplary embodiment of the present invention, the inner plate member 300 may include a counter piece 320 that is supported in contact with the support piece 250. The counter piece 320 may be formed to extend by a certain distance so as to be in surface contact with the support piece 250 in the width direction X or the height direction Z while being formed to extend by a certain distance inward in the depth direction Y toward the flow plate member 200. As such, when the support piece 250 and the counter piece 320 are formed to extend by a certain distance along the depth direction Y, it is possible to easily secure a space in which the flow plate member 200 can be disposed between the inner plate members 300. In addition, as the support piece 250 and the counter piece 320 are supported in contact with each other, the assembly state between the flow plate member 200 and the inner plate member 300 is stably maintained, and thus, it is possible to secure structural stability even after using for a long period of time.

As illustrated in FIG. 5, in the running-water-type evaporator according to an exemplary embodiment of the present invention, bonding surfaces 130 that can be mutually bonded may be provided on the periphery of the pair of outer plate member 100, respectively. When the bonding surfaces 130 are respectively provided on the periphery of the pair of outer plate members 100 in this way, these members may be stably coupled to each other as well as the inside of the pair of outer plate members 100 is sealed, and thus, since the air or ice-making water W1 is not introduced, it is possible to prevent the degradation in cleanliness of the ice-making water W1.

In this case, as illustrated in FIG. 5, in the running-water-type evaporator according to an exemplary embodiment of the present invention, a bent surface 140 that is bent inwardly may be provided around the periphery of the pair of outer plate members 100 that are disposed to face each other, respectively, and the bonding surface 130 may be provided at the tip of the bent surface 140. That is, the bent surfaces 140 are formed on each of the pair of outer plate members 100 to easily secure an internal space in which the flow plate member 200 can be disposed, thereby improving manufacturability.

As described above, the running-water-type evaporator 20 used in the ice-making device may include a pair of outer plate members 100 that are disposed to face each other; and a flow plate member 200 which is disposed between the pair of outer plate members 100 to partition a space between the pair of outer plate members 100 so as to form a first flow path 201 through which a low-temperature fluid for generating ice C or a high-temperature fluid for separating the generated ice C flows, and wherein the outer plate member 100 includes a heat transfer surface 120 which is formed on the inside to thermally contact the fluid, an ice generating surface 110 which is formed on the outside such that a first surface C1 of ice C is formed to be attached thereto, a partition wall 111 which protrudes outward to partition the ice generating surface 110 such that a second surface C2 which is formed to extend from the first surface C1 of ice C is attached thereto and extends in a direction crossing the flow direction of the fluid flowing through the first flow path 201, and a supply groove 112*a* which protrudes outward to form a second flow path 112 that communicates with the inside of the partition wall 111 such that a high-temperature fluid is supplied to the inside of the partition wall 111. That is, in order to separate the ice, it is necessary to quickly separate the first surface C1 and the second surface C2 of the ice C. To this end, a high-temperature fluid may be supplied to the inside of the flow plate member 200, and as illustrated in FIG. 5, heat supplied through the high-temperature fluid flowing through the flow plate member 200 is transferred to the ice C through the heat transfer surface 120 and the ice generating surface 110 such that the first surface C1 is separated from the ice generating surface 110. Moreover, at the same time, the high-temperature fluid supplied through the supply groove 112*a* moves to the inside of the partition wall 111 through the second flow path 112, and it is transferred to the partition wall 111 through the high-temperature fluid flowing inside the partition wall 111 such that the second surface C2 may be configured to be separated from the partition wall 111. That is, heat supplied through the high-temperature fluid flowing through the flow plate member 200 and the high-temperature fluid flowing inside the partition wall 111 of the outer plate member 100 during ice separation is evenly transferred to the ice C, and since the ice C can be easily separated without using separate ice-separating water, the degree of melting of the ice C during ice separation is minimized. In addition, since the ice-making water W1 is configured to circulate while flowing only to the outer sides of the pair of outer plate members 100, it is possible to effectively prevent the degradation in cleanliness of the ice C as well as the circulating ice-making water W1.

Meanwhile, as described above, the running-water-type evaporator 20 used in the water purification device may also include a pair of outer plate members 100 that are disposed to face each other; and a flow plate member 200 which is disposed between the pair of outer plate members 100 to partition a space between the pair of outer plate members 100 so as to form a first flow path 201 through which a low-temperature fluid for generating ice C or a high-temperature fluid for separating the generated ice C flows, and wherein the outer plate member 100 includes a heat transfer surface 120 which is formed on the inside to thermally contact the fluid, an ice generating surface 110 which is formed on the outside such that a first surface C1 of ice C is formed to be attached thereto, a partition wall 111 which protrudes outward to partition the ice generating surface 110 such that a second surface C2 which is formed to extend from the first surface C1 of ice C is attached thereto and extends in a direction crossing the flow direction of the fluid flowing through the first flow path 201, and a supply groove 112*a* which protrudes outward to form a second flow path 112 that communicates with the inside of the partition wall 111 such that a high-temperature fluid is supplied to the inside of the partition wall 111. That is, in order to separate the ice, it is necessary to quickly separate the first surface C1 and the second surface C2 of the ice C. To this end, a high-temperature fluid may be supplied to the inside of the flow plate member 200, and as illustrated in FIG. 5, heat supplied through the high-temperature fluid flowing through the flow plate member 200 is transferred to the ice C through the heat transfer surface 120 and the ice generating surface 110 such that the first surface C1 is separated from the ice generating surface 110. Moreover, at the same time, the high-temperature fluid supplied through the supply groove 112*a* moves to the inside of the partition wall 111 through the second flow path 112, and it is transferred to the partition wall 111 through the high-temperature fluid flowing inside the partition wall 111 such that the second surface C2 may be configured to be separated from the partition wall 111. That is, heat supplied through the high-temperature fluid flowing through the flow plate member 200 and the high-temperature fluid flowing inside the partition wall 111 of the outer plate member 100 during ice separation is evenly transferred to the ice C, and since the ice C can be easily separated without using separate ice-separating water, the degree of melting of the ice C during ice separation is minimized. In addition, since the ice-making water W1 is configured to circulate while flowing only to the outer sides of the pair of outer plate members 100, it is possible to effectively prevent the degradation in cleanliness of the ice C as well as the circulating ice-making water W1.

As described above, since the running-water-type evaporator, the ice-making device and the water purification device including the same according to an exemplary embodiment of the present invention are configured such that heat supplied through a high-temperature fluid is evenly transferred to the ice C during ice separation such that the ice can be separated without using separate ice-separating water, the degree of melting of ice is minimized during ice separation, and also, the ice making water W1 circulates while flowing only to the outer sides of the pair of outer plate members 100, and thus, it is possible to effectively prevent the degradation in cleanliness of ice-making water W1.

Although the exemplary embodiments of the present invention have been described, the spirit of the present invention is not limited to the exemplary embodiments set forth herein. Those of ordinary skill in the art who understand the spirit of the present invention may easily propose other exemplary embodiments by modifying, changing, deleting or adding elements within the same spirit, but this will also be said to fall within the scope of the present invention.

The invention claimed is:

1. A running-water-type evaporator, comprising:

a pair of outer plate members that are disposed to face each other; and a flow plate member which is disposed between the pair of outer plate members to partition a space between the pair of outer plate members so as to form a first flow path through which a low-temperature fluid for generating ice or a high-temperature fluid for separating the generated ice flows, wherein each outer plate member of the pair of outer plate members comprises a heat transfer surface which is formed on an inside of each plate of the pair of outer plate members to thermally contact the low temperature or high temperature fluid, an ice generating surface which is formed on an outside of each plate of the pair of outer plate members such that a first surface of ice is formed to be attached to the outside of each plate of the pair of outer plate members, a partition wall which protrudes outward to partition the ice generating surface such that a second surface of the ice which is formed to extend from the first surface of ice is attached to the partition wall and extends in a direction crossing the flow direction of the low temperature or high temperature fluid flowing through the first flow path, and a supply groove which protrudes outward to form a second flow path that communicates with an inside of the partition wall such that the high-temperature fluid is supplied to the inside of the partition wall.

2. The running-water-type evaporator of claim 1, further comprising:

an inner plate member which is disposed to be bonded to the heat transfer surface so as to prevent the low temperature or high temperature fluid flowing inside the supply groove and the partition wall from leaking into a space between the pair of outer plate members.

3. The running-water-type evaporator of claim 1, wherein the partition wall is formed to extend in parallel with a direction in which ice-making water flows, wherein the partition wall is a plurality of the partition walls that are disposed to be spaced apart from each other at regular intervals, and wherein at least one outer plate member of the pair of outer plate members further comprises a connection groove such that the partition walls that are disposed to be adjacent to each other communicate with each other, and a discharge groove through which the low temperature or high temperature fluid flowing inside the plurality of partition walls is discharged.

4. The running-water-type evaporator of claim 3, wherein the supply groove is in communication with at least one of the plurality of partition walls to supply the high-temperature fluid to the inside of the partition wall, and wherein the high-temperature fluid supplied to the partition wall is discharged through the discharge groove after moving to another partition wall of the plurality of partition walls that is disposed to be adjacent to the partition wall through the connection groove.

5. The running-water-type evaporator of claim 2, wherein the flow plate member is a pair of flow plate members and are each provided so as to face each other, and wherein each of the flow plate members of the pair of flow plate members comprises a main groove that protrudes outward.

6. The running-water-type evaporator of claim 5, wherein the pair of flow plate members each comprises a first opening hole that is formed to penetrate such that the low temperature or high temperature fluid flows through the main groove and directly contacts the heat transfer surface.

7. The running-water-type evaporator of claim 6, wherein the inner plate member comprises a second opening hole that is formed to penetrate such that the low temperature or high temperature fluid passes through the first opening hole and directly contacts the heat transfer surface.

8. The running-water-type evaporator of claim 7, wherein each of the pair of flow plate members comprises a heat transfer column that protrudes outward along the main groove and makes surface contact with the heat transfer surface, and wherein the first opening hole is provided at a front end of the heat transfer column.

9. The running-water-type evaporator of claim 8, wherein a support surface which supports an outer side surface of the heat transfer column in a state where the heat transfer column is inserted is provided around the periphery of the second opening hole.

10. The running-water-type evaporator of claim 2, wherein the supply groove comprises a plurality of supply grooves and the pair of outer plate members are each provided with one of the plurality the supply grooves, respectively, and wherein the inner plate member is disposed to be bonded to each of the pair of outer plate members.

11. The running-water-type evaporator of claim 2, wherein the flow plate member comprises a pair of flow plate members, and wherein among the pair of flow plate members, any one of the flow plate members comprises a coupling piece that is coupled to the other flow plate member.

12. The running-water-type evaporator of claim 2, wherein the flow plate member comprises a pair of flow plate members, and wherein among the pair of flow plate members, any one of the flow plate members comprises a support piece that is supported in contact with the inner plate member.

13. The running-water-type evaporator of claim 12, wherein the inner plate member comprises a counter piece that is supported in contact with the support piece.

14. The running-water-type evaporator of claim 1, wherein bonding surfaces that are capable of mutual bonding are provided around a periphery of the pair of outer plate members, respectively.

15. The running-water-type evaporator of claim 14, wherein bent surfaces that are bent inward are provided around the periphery of the pair of outer plate members that are disposed to face each other, and wherein the bonding surfaces are provided at a front end of the bent surface.

* * * * *